US009931682B2

(12) United States Patent
Imamura et al.

(10) Patent No.: US 9,931,682 B2
(45) Date of Patent: Apr. 3, 2018

(54) SPINNING FORMING DEVICE AND SPINNING FORMING METHOD

(71) Applicant: KAWASAKI JUKOGYO KABUSHIKI KAISHA, Kobe-shi, Hyogo (JP)

(72) Inventors: Yoshihide Imamura, Kobe (JP); Yuto Sakane, Kobe (JP); Kohei Mikami, Akashi (JP); Hayato Iwasaki, Kobe (JP); Hiroshi Kitano, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 15/039,891

(22) PCT Filed: Nov. 6, 2014

(86) PCT No.: PCT/JP2014/005586
§ 371 (c)(1),
(2) Date: May 27, 2016

(87) PCT Pub. No.: WO2015/079628
PCT Pub. Date: Jun. 4, 2015

(65) Prior Publication Data

US 2017/0001229 A1 Jan. 5, 2017

(30) Foreign Application Priority Data

Nov. 29, 2013 (JP) ..... 2013-247194

(51) Int. Cl.
*B21D 22/14* (2006.01)
*B21D 37/16* (2006.01)

(52) U.S. Cl.
CPC ..... *B21D 22/14* (2013.01); *B21D 37/16* (2013.01)

(58) Field of Classification Search
CPC ..... B21D 22/14; B21D 22/16; B21D 22/18
See application file for complete search history.

(56) References Cited

U.S. PATENT DOCUMENTS 3,815,395 A * 6/1974 Sass ..... B21D 22/18 72/342.1
2013/0152652 A1 6/2013 Allwood et al.

FOREIGN PATENT DOCUMENTS

CN 103108709 A 5/2013
JP S48-41965 A 6/1973
(Continued)

OTHER PUBLICATIONS

Jul. 27, 2016 Office Action issued in Taiwanese Patent Application No. 103139150.
(Continued)

*Primary Examiner* — Debra Sullivan
(74) *Attorney, Agent, or Firm* — Oliff PLC

(57) ABSTRACT

A spinning forming device includes: a receiving jig supporting a central portion of a plate to be formed; and a rotating shaft to which the receiving jig is attached. The spinning forming device also includes: a heater configured to locally heat a transform target portion of the plate by induction heating; and a processing tool configured to press the transform target portion to transform the plate. The spinning forming device further includes a pair of holding rollers configured to sandwich an outside portion of the plate, the outside portion being located outside the transform target portion.

9 Claims, 3 Drawing Sheets

(56) References Cited

FOREIGN PATENT DOCUMENTS

| | | | |
|---|---|---|---|
| JP | S49-95859 | A | 9/1974 |
| JP | 2011-218427 | A | 11/2011 |
| JP | 2012-192414 | A | 10/2012 |
| WO | 2014/024384 | A1 | 2/2014 |

OTHER PUBLICATIONS

May 31, 2016 International Preliminary Report on Patentability issued in International Patent Application No. PCT/JP2014/005586.
Jan. 20, 2015 Search Report issued in International Patent Application No. PCT/JP2014/005586.

* cited by examiner

SPINNING FORMING DEVICE AND SPINNING FORMING METHOD

TECHNICAL FIELD

The present invention relates to a spinning forming device and method for forming a plate in a desired shape while rotating the plate.

BACKGROUND ART

Conventionally known is a spinning forming device designed to transform a plate by pressing a processing tool against the plate while rotating the plate. The spinning forming device normally includes a mandrel (shaping die) attached to a rotating shaft and performs forming in such a manner that the plate is pressed against the mandrel by the processing tool.

In recent years, proposed is a spinning forming device designed to perform spinning forming while locally heating the plate. For example, as a spinning forming device for a titanium alloy, PTL 1 discloses a spinning forming device configured such that a portion of the plate which is pressed against the mandrel by a spatula (processing tool) is heated by high frequency induction heating.

CITATION LIST

Patent Literature

PTL 1: Japanese Laid-Open Patent Application Publication No. 2011-218427

SUMMARY OF INVENTION

Technical Problem

The inventors of the present invention have found that by locally heating the plate by induction heating, the plate can be transformed into a final shape in the atmosphere without using the mandrel. From this point of view, in an application (Japanese Patent Application No. 2012-178269) preceding the present application, the applicant of the present application has proposed execution of spinning forming using, instead of the mandrel, a receiving jig supporting a central portion of the plate. According to this spinning forming, at a position away from the receiving jig, a transform target portion of the plate is heated by a heater and is pressed by the processing tool.

When using the mandrel, the transform target portion of the plate is pressed against the mandrel by the processing tool. Therefore, a peripheral portion of the plate hardly deforms. On the other hand, when using the receiving jig against which the plate is not pressed by the processing tool, in other words, when using the receiving jig not including a shaping surface, the plate is processed with the transform target portion floating in the air. Therefore, the peripheral portion of the plate deforms in some cases. Such deformation (for example, warp) of the peripheral portion of the plate may cause contact between the peripheral portion of the plate and a peripheral device such as a heater and bring about a deterioration of accuracy (formation accuracy) of the final shape.

An object of the present invention is to suppress the deformation of the peripheral portion of the plate in the spinning forming using the receiving jig supporting the central portion of the plate.

Solution to Problem

To achieve the above object, a spinning forming device of the present invention includes: a receiving jig supporting a central portion of a plate to be formed; a rotating shaft to which the receiving jig is attached; a heater configured to locally heat a transform target portion of the plate by induction heating; a processing tool configured to press the transform target portion to transform the plate; and a pair of holding rollers configured to sandwich an outside portion of the plate, the outside portion being located outside the transform target portion.

According to the above configuration, the plate is processed in a state where the holding rollers sandwich the outside portion, located outside the transform target portion, of the plate. Therefore, the deformation of the peripheral portion of the plate can be suppressed.

The spinning forming device may be configured such that: the pair of holding rollers sandwich a peripheral portion of the plate; and when the processing tool presses the transform target portion, the pair of holding rollers are moved in an axial direction of the rotating shaft together with the processing tool. According to this configuration, a uniaxial movement mechanism can be used as means for moving the holding rollers. Therefore, the configuration can be simplified.

The spinning forming device may be configured such that: one of the pair of holding rollers has a cylindrical shape that makes line contact with one of surfaces of the plate; and the other holding roller has a tapered shape that makes point contact with the other surface of the plate and decreases in diameter toward a direction away from the rotating shaft. According to this configuration, one of the holding rollers makes line contact with the plate, and the other makes point contact with the plate. Therefore, while stably holding the outside portion of the plate, a load necessary for the rotation of the plate can be reduced.

The heater may be disposed on an opposite side of the processing tool across the plate. According to this configuration, regardless of the shape of the plate during processing, the heater can be located immediately close to the transform target portion of the plate. With this, the transform target portion can be appropriately heated.

A spinning forming method of the present invention includes pressing a processing tool against a transform target portion of a plate to be formed to transform the plate while locally heating the transform target portion by induction heating in a state where an outside portion of the plate is sandwiched between a pair of holding rollers, the outside portion being located outside the transform target portion. According to this configuration, the plate is processed in a state where the outside portion, located outside the transform target portion, of the plate is sandwiched between the holding rollers. Therefore, the deformation of the peripheral portion of the plate can be suppressed.

Advantageous Effects of Invention

According to the present invention, the deformation of the peripheral portion of the plate can be suppressed in the spinning forming using the receiving jig supporting the central portion of the plate.

BRIEF DESCRIPTION OF DRAWINGS

FIG. 2B is a cross-sectional view taken along line II-II of FIG. 2A.

DESCRIPTION OF EMBODIMENTS

Figure 1:
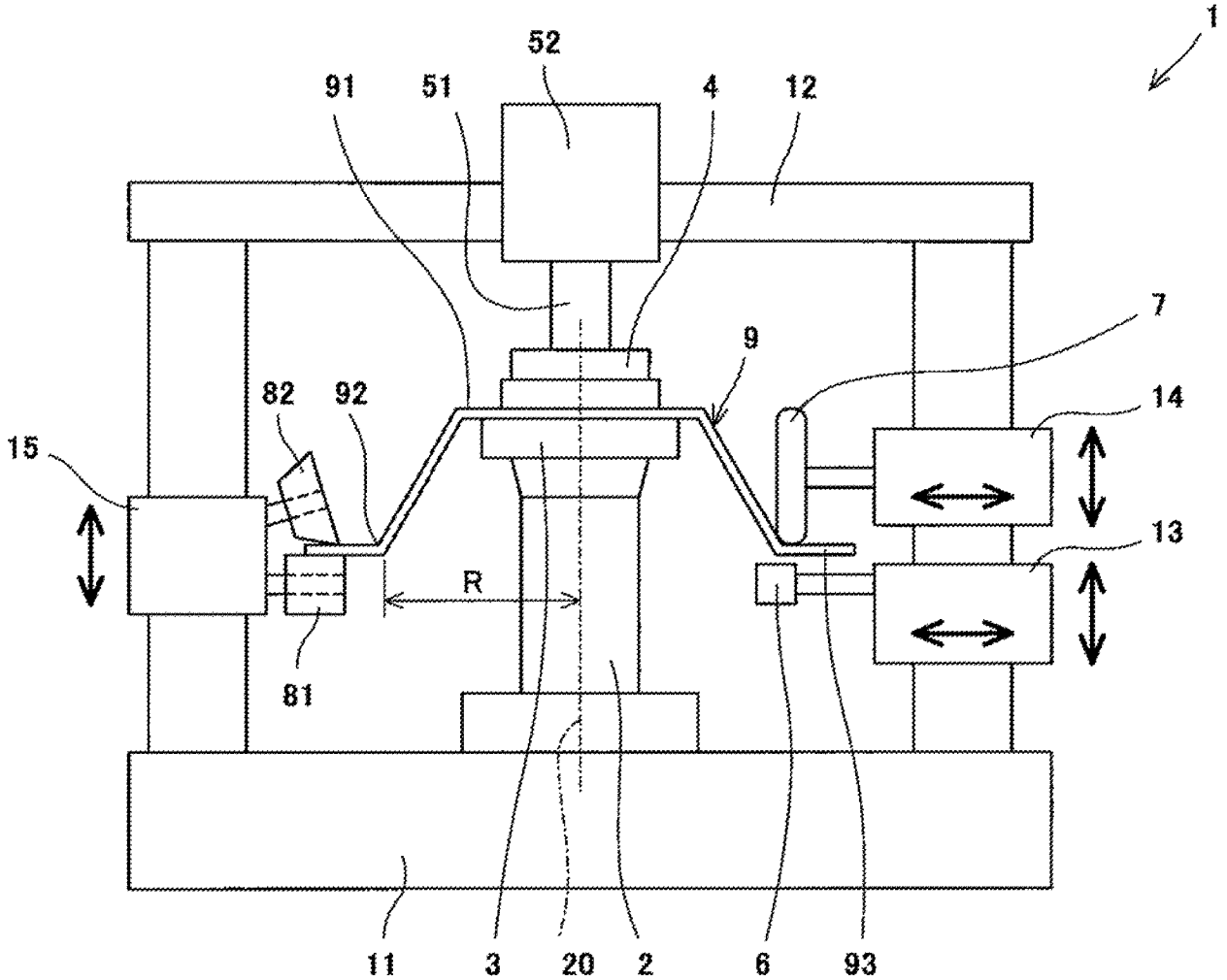
FIG. 1 is a schematic configuration diagram of a spinning forming device according to one embodiment of the present invention.

FIG. 1 shows a spinning forming device 1 according to one embodiment of the present invention. The spinning forming device 1 includes a rotating shaft 2, a receiving jig 3 attached to the rotating shaft 2, and a fixing jig 4. The receiving jig 3 supports a central portion 91 of a plate 9 to be formed, and the fixing jig 4 sandwiches the plate 9 together with the receiving jig 3. The spinning forming device 1 further includes: a heater 6 configured to locally heat a transform target portion 92 of the plate 9 by induction heating, the transform target portion 92 being located away from a center axis 20 of the rotating shaft 2 by a predetermined distance R; and a processing tool 7 configured to press the transform target portion 92 to transform the plate 9.

An axial direction of the rotating shaft 2 (i.e., a direction in which the center axis 20 extends) is a vertical direction in the present embodiment. However, the axial direction of the rotating shaft 2 may be a horizontal direction or an oblique direction. A lower portion of the rotating shaft 2 is supported by a base 11. A motor (not shown) configured to rotate the rotating shaft 2 is disposed in the base 11. An upper surface of the rotating shaft 2 is flat, and the receiving jig 3 is fixed to the upper surface of the rotating shaft 2.

The plate 9 is, for example, a flat circular plate. However, the shape of the plate 9 may be a polygonal shape or an oval shape. The plate 9 is not necessarily flat over the entirety. For example, the central portion 91 of the plate 9 may be thicker than a peripheral edge portion 93 of the plate 9, or the entire plate 9 or a part of the plate 9 may be processed in advance to have a tapered shape. The material of the plate 9 is not especially limited and is, for example, a titanium alloy.

The receiving jig 3 has a size within a circle defined by a forming start position of the plate 9. For example, in a case where the receiving jig 3 has a disc shape, a diameter of the receiving jig 3 is equal to or smaller than a diameter of the circle defined by the forming start position of the plate 9. Unlike conventional mandrels, the plate 9 is not transformed by being pressed against a radially outer side surface of the receiving jig 3.

The fixing jig 4 is attached to a pressurizing rod 51. The pressurizing rod 51 is driven by a driving portion 52 in an upward/downward direction to press the plate 9 against the receiving jig 3 via the fixing jig 4. For example, the pressurizing rod 51 and the driving portion 52 constitute a hydraulic cylinder. The driving portion 52 is fixed to a portal frame 12 standing on the base 11, and a bearing rotatably supporting the pressurizing rod 51 is incorporated in the driving portion 52.

It should be noted that the pressurizing rod 51 and the driving portion 52 are not necessarily required. For example, the fixing jig 4 may be fixed to the receiving jig 3 together with the plate 9 by fastening members, such as bolts or clamps. Or, the fixing jig 4 may be omitted, and the plate 9 may be directly fixed to the receiving jig 3 by, for example, bolts.

In the present embodiment, the processing tool 7 that presses the transform target portion 92 of the plate 9 is disposed above the plate 9, and the plate 9 is processed by the processing tool 7 in a downwardly opening shape that accommodates the receiving jig 3. To be specific, an upper surface of the plate 9 is a front surface, and a lower surface of the plate 9 is a rear surface. However, the processing tool 7 may be disposed under the plate 9, and the plate 9 may be processed by the processing tool 7 in an upwardly opening shape that accommodates the fixing jig 4. Or, to form a projection(s) and a depression(s) on the plate 9, the position of the processing tool 7 may be changed from the upper side of the plate 9 to the lower side of the plate 9 or vice versa in the middle of the processing of the plate 9.

In the present embodiment, the heater 6 that heats the transform target portion 92 of the plate 9 is disposed under the plate 9. In other words, the heater 6 is located on the opposite side of the processing tool 7 across the plate 9. However, the heater 6 may be disposed above the plate 9 so as to be located at the same side as the processing tool 7.

For convenience of explanation, FIG. 1 shows a layout in which the heater 6 is located immediately under the processing tool 7. However, the relative positions of the heater 6 and the processing tool 7 are not especially limited as long as they are located on substantially the same circumference around the center axis 20 of the rotating shaft 2. For example, the heater 6 and the processing tool 7 may be located at respective positions opposed to each other across the rotating shaft 2.

The heater 6 is moved by a first movement mechanism 13 in the axial direction and radial direction of the rotating shaft 2. The processing tool 7 is moved by a second movement mechanism 14 in the axial direction and radial direction of the rotating shaft 2. As the processing of the plate 9 proceeds, the transform target portion 92 travels in the axial direction and radial direction of the rotating shaft 2. Therefore, during the processing of the plate 9, the heater 6 and the processing tool 7 are moved in conjunction with each other.

In the present embodiment, used as the processing tool 7 is a roller configured to follow the rotation of the plate 9 to rotate. However, the processing tool 7 is not limited to the roller and may be, for example, a spatula.

Figure 2A:
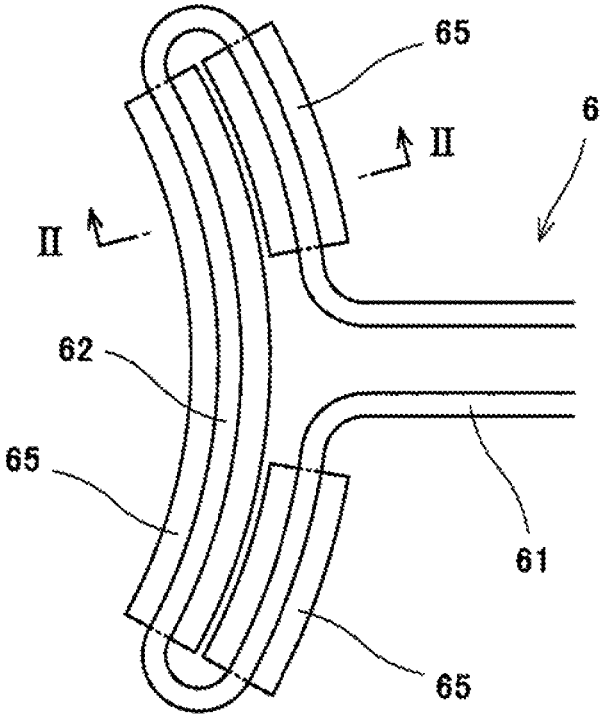
FIG. 2A is a plan view of a heater.

As shown in FIGS. 2A and 2B, the heater 6 includes: a conducting wire 61 including a coil portion 62 extending in a circumferential direction of the rotating shaft 2 and having a doubled circular-arc shape; and cores 65 for collecting magnetic flux generated around the coil portion 62. More specifically, the coil portion 62 includes a pair of circular-arc portions that are parallel to each other along the plate 9, in other words, spaced apart from each other in the radial direction of the rotating shaft 2. The cores 65 are supported by a supporting plate not shown.

The frequency of an alternating current flowing through the conducting wire 61 is not especially limited and is desirably a high frequency of 5 to 400 kHz. To be specific, it is desirable that the induction heating by the heater 6 be high frequency induction heating. According to the induction heating, the temperature of a lower surface of the transform target portion 92 which faces the coil portion 62 becomes the highest by a skin effect. For example, in a case where the material of the plate 9 is the titanium alloy, the temperature of the lower surface of the transform target portion 92 is about 500 to 1,000° C.

The spinning forming device 1 of the present embodiment includes a pair of holding rollers 81 and 82 configured to sandwich an outside portion of the plate 9 from both sides of the plate 9 in a thickness direction of the plate 9, the outside portion being located outside the transform target portion 92. The holding rollers 81 and 82 may be disposed at any positions as long as the holding rollers 81 and 82 do not interfere with the heater 6 or the processing tool 7.

In the present embodiment, the pair of holding rollers 81 and 82 sandwiches the peripheral portion of the plate 9. To be specific, the pair of holding rollers 81 and 82 sandwiches the peripheral portion of the plate 9 so as to press the peripheral portion of the plate 9 in the thickness direction of the plate 9. The holding rollers 81 and 82 are moved by a third movement mechanism 15 together with the processing tool 7 in the axial direction of the rotating shaft 2 when the processing tool 7 presses the transform target portion 92 of the plate 9. It should be noted that the number of movement mechanisms for the holding rollers 81 and 82 is not limited to one, and one movement mechanism may be provided for each of the holding rollers 81 and 82.

Figure 3:
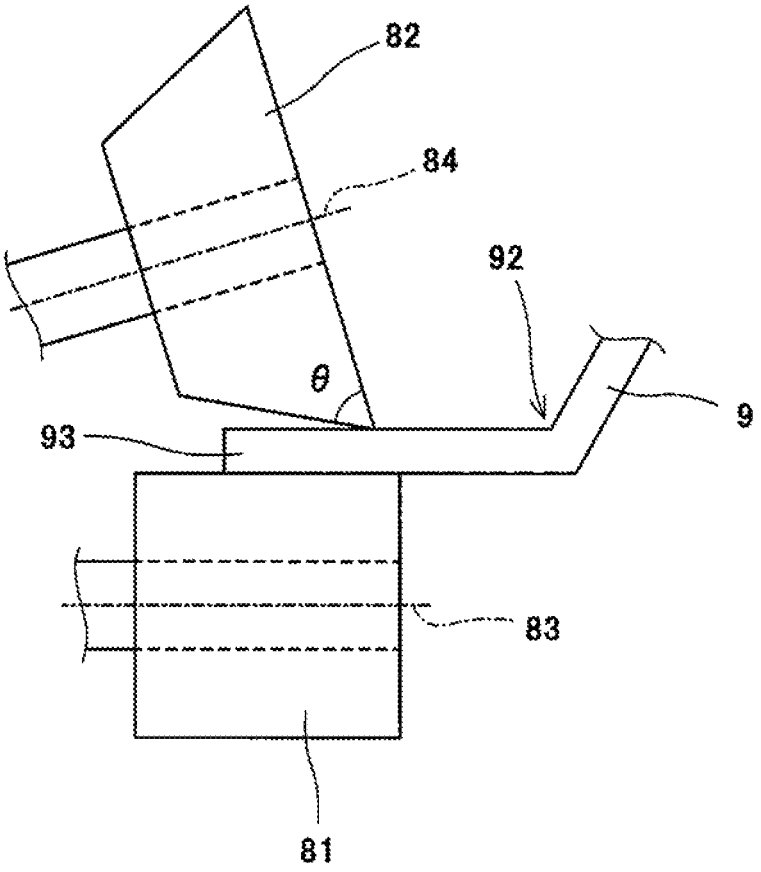
FIG. 3 is an enlarged view of major portions of the spinning forming device shown in FIG. 1.

In the present embodiment, the holding roller 81 disposed under the plate 9 has a cylindrical shape, and the holding roller 82 disposed above the plate 9 has a tapered shape (i.e., a shape having a trapezoidal cross section) that decreases in diameter toward a direction away from the rotating shaft 2. As shown in FIG. 3, a center axis 83 of the holding roller 81 at the lower side is parallel to the peripheral portion 93 of the plate 9. Therefore, the bolding roller 81 makes line contact with a lower surface of the plate 9. On the other hand, a center axis 84 of the holding roller 82 at the upper side extends in a direction represented by a formula "$\alpha<90°-\theta$", where $\alpha$ denotes an angle between the center axis 84 and the peripheral portion 93 of the plate 9, and $\theta$ denotes an angle between a large-diameter tip end surface and peripheral side surface of the holding roller 82. In other words, the center axis 84 of the holding roller 82 is inclined so as to become close to a horizontal state from a state where the peripheral side surface of the holding roller 82 makes line contact with the upper surface of the plate 9. Therefore, the holding roller 82 makes point contact with the upper surface of the plate 9 by a tip end peripheral portion between the large-diameter tip end surface and the peripheral side surface. However, the center axis 84 of the holding roller 82 may extend in the horizontal direction or may be inclined in a direction opposite to the direction of FIG. 3 such that an angle between the large-diameter tip end surface of the holding roller 82 and the peripheral portion 93 of the plate 9 becomes an acute angle.

It should be noted that the shapes of the holding rollers 81 and 82 are not limited to these. For example, contrary to the present embodiment, the holding roller 81 at the lower side may have a tapered shape, and the holding roller 81 at the upper side may have a cylindrical shape. Or, the holding rollers 81 and 82 may have the same shape such as a cylindrical shape or a tapered shape. Further, one or both of the holding rollers 81 and 82 may have a spherical shape that makes point contact with the plate 9.

Thus, the spinning forming device 1 explained above can execute a spinning forming method of pressing the processing tool 7 against the transform target portion 92 of the plate 9 to transform the plate 9 while locally heating the transform target portion 92 by the induction heating in a state where the outside portion of the plate 9 is sandwiched between the holding rollers 81 and 82, the outside portion being located outside the transform target portion 92. As above, according to the present embodiment, since the plate 9 is processed in a state where the outside portion, located outside the transform target portion 92, of the plate 9 is sandwiched between the holding rollers 81 and 82, the deformation of the peripheral portion 93 of the plate 9 can be suppressed.

Further, in the present embodiment, one of the holding rollers 81 and 82 makes line contact with the plate 9, and the other makes point contact with the plate 9. Therefore, while stably holding the outside portion of the plate 9 (in the present embodiment, the peripheral portion 93), a load necessary for the rotation of the plate 9 can be reduced.

Furthermore, in the present embodiment, the heater 6 is disposed on the opposite side of the processing tool 7 across the plate 9. Therefore, regardless of the shape of the plate 9 during processing, the heater 6 can be located immediately close to the transform target portion 92 of the plate 9. With this, the transform target portion 92 can be appropriately heated.

Other Embodiments

The present invention is not limited to the above embodiment, and various modifications may be made within the scope of the present invention.

For example, at least one of the holding rollers 81 and 82 may be moved also in the radial direction of the rotating shaft 2 so as to always contact an outside portion, located immediately outside the transform target portion 92, of the plate 9. Even in this case, the holding rollers 81 and 82 sandwich the outside portion, located outside the transform target portion 92, of the plate 9. In a case where the holding rollers 81 and 82 sandwiches the peripheral portion 93 of the plate 9 as in the above embodiment, a uniaxial movement mechanism can be used as means for moving the holding rollers 81 and 82. Therefore, the configuration can be simplified.

INDUSTRIAL APPLICABILITY

The present invention is useful when performing spinning forming of plates made of various materials.

REFERENCE SIGNS LIST

1 spinning forming device
2 rotating shaft
3 receiving jig
6 heater
7 processing tool
81, 82 holding roller
9 plate
91 central portion
92 transform target portion
93 peripheral portion

The invention claimed is:

1. A spinning forming device comprising:

a receiving jig supporting a central portion of a plate to be formed;

a rotating shaft to which the receiving jig is attached;

a heater configured to locally heat a transform target portion of the plate by induction heating;

a processing tool configured to press the transform target portion to transform the plate; and a pair of holding rollers configured to sandwich an outside portion of the plate, the outside portion being located radially outside of the locally heated transform target portion of the plate.

2. The spinning forming device according to claim 1, wherein:

the pair of holding rollers sandwich a peripheral portion of the plate; and when the processing tool presses the transform target portion, the pair of holding rollers are moved in an axial direction of the rotating shaft together with the processing tool.

3. The spinning forming device according to claim 1, wherein:

one of the pair of holding rollers has a cylindrical shape that makes line contact with one of surfaces of the plate; and the other holding roller has a tapered shape that makes point contact with the other surface of the plate and decreases in diameter toward a direction away from the rotating shaft.

4. The spinning forming device according to claim 1, wherein the heater is disposed on an opposite side of the plate from the processing tool.

5. The spinning forming device according to claim 2, wherein:

one of the pair of holding rollers has a cylindrical shape that makes line contact with one of surfaces of the plate; and the other holding roller has a tapered shape that makes point contact with the other surface of the plate and decreases in diameter toward a direction away from the rotating shaft.

6. The spinning forming device according to claim 2, wherein the heater is disposed on an opposite side of the plate from the processing tool.

7. The spinning forming device according to claim 3, wherein the heater is disposed on an opposite side of the plate from the processing tool.

8. The spinning forming device according to claim 5, wherein the heater is disposed on an opposite side of the plate from the processing tool.

9. A spinning forming method comprising pressing a processing tool against a transform target portion of a plate to be formed to transform the plate while locally heating the transform target portion by induction heating in a state where an outside portion of the plate is sandwiched between a pair of holding rollers, the outside portion being located radially outside of the locally heated transform target portion of the plate.

* * * * *